US009315957B2

(12) United States Patent
Seeley

(10) Patent No.: US 9,315,957 B2
(45) Date of Patent: Apr. 19, 2016

(54) UNIVERSAL SNOW PLOW MOUNTING APPARATUS

(71) Applicant: Bruce Edwin Seeley, Princeton (CA)

(72) Inventor: Bruce Edwin Seeley, Princeton (CA)

(73) Assignee: Tiercel Technology Corp., Princeton, Ontario ( * ) Notice: Subject to any disclaimer, the term of this patent is extended or adjusted under 35 U.S.C. 154(b) by 0 days.

(21) Appl. No.: 14/059,272

(22) Filed: Oct. 21, 2013

(65) Prior Publication Data

US 2014/0123523 A1 May 8, 2014

Related U.S. Application Data

(60) Provisional application No. 61/722,651, filed on Nov. 5, 2012.

(51) Int. Cl.
*E01H 5/06* (2006.01)

(52) U.S. Cl.
CPC ..... *E01H 5/06* (2013.01)

(58) Field of Classification Search
USPC ..... 37/231
IPC ..... E01H 5/06
See application file for complete search history.

(56) References Cited

U.S. PATENT DOCUMENTS

| | | | | |
|---|---|---|---|---|
| 4,619,060 | A * | 10/1986 | Knowlton | 37/231 |
| 4,813,164 | A * | 3/1989 | Morrell | 37/241 |
| 5,111,603 | A * | 5/1992 | Knowlton et al. | 37/231 |
| 6,276,076 | B1 * | 8/2001 | Quenzi et al. | 37/231 |
| 6,615,513 | B2 * | 9/2003 | Quenzi et al. | 37/231 |
| 7,146,754 | B2 * | 12/2006 | Schultz et al. | 37/231 |
| 8,739,436 | B2 * | 6/2014 | Hill | 37/231 |
| 8,769,847 | B2 * | 7/2014 | Coulombe et al. | 37/231 |

* cited by examiner

*Primary Examiner* — Gary Hartmann

(57) ABSTRACT

A height adjustable snow plow mounting apparatus includes an elongated member having a snow plow mounting member positioned at each end thereof. A vehicle mounting member positioned on the elongated member engages a receiver on the motor vehicle for the purpose of releasably connecting the snow plow mounting apparatus to the vehicle. A support member comprising an extended sleeve which substantially spans the length of the elongated member functions to secure the vehicle mounting member to the elongated member. By simply reversing the position of the elongated member relative to the support member, the snow plow mounting members may be positioned above or below the horizontal plane of the vehicle mounting member. In turn, the apparatus readily supports two different heights of the vehicle mounting member relative to the motor vehicle, which heights are based upon standard height differences in motor vehicle ground clearance.

14 Claims, 18 Drawing Sheets

UNIVERSAL SNOW PLOW MOUNTING APPARATUS

FIELD

The present invention relates to snow removal equipment and in particular to snow plows for vehicles.

BRIEF DESCRIPTION OF THE DRAWINGS

In the drawings, preferred embodiments of the invention are illustrated by way of example. It is to be expressly understood that the description and drawings are only for the purpose of illustration and as an aid to understanding, and are not intended as a definition of the limits of the invention.

Further aspects and advantages of the present invention will become apparent from the following description taken together with the accompanying drawings in which.

DETAILED DESCRIPTION

Figure 1:
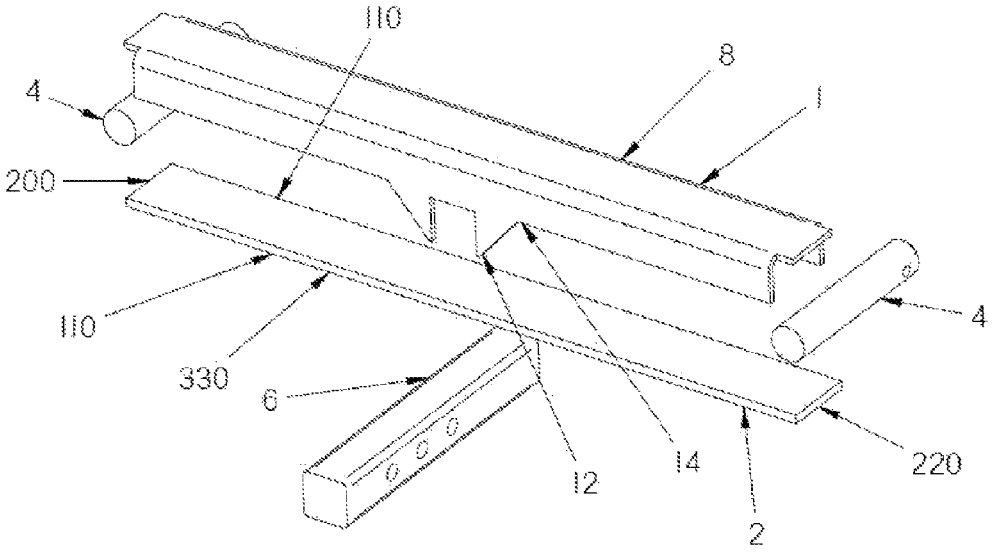
FIG. 1 is an exploded perspective view of a first embodiment of a universal snow plow mounting apparatus as described herein.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Snow plows and mounting accessories for securing snow plows to vehicles (including but not limited to cars, trucks, vans, sport utility vehicles, farm and yard equipment, and all-terrain vehicles) are known in the art. The present disclosure relates to a universal snow plow mounting apparatus for use in releasably attaching a snow plow to a vehicle, such as a car, truck or sport utility vehicle. The mounting apparatus is to a vehicle's receiver or receiver hitch. The universal snow plow mounting apparatus is adjustable in height depending on the orientation in which it is secured to the snow plow. Further, a secondary mechanism of height adjustability is achieved through the position in which the snow plow is secured to the apparatus.

All references in this specification to universal snow plow mounting apparatus, mounting apparatus, and apparatus, apply equally to the universal snow plow mounting apparatus of the present invention.

Figure 17:
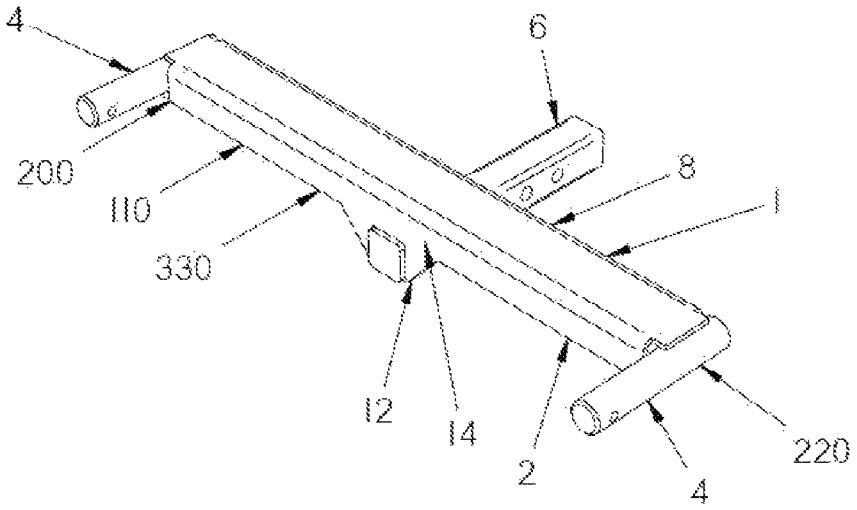
FIG. 17 is a perspective view of the universal snow plow mounting apparatus of FIG. 1.

Referring to FIGS. 1 and 17, there is shown a universal snow plow mounting apparatus 1 in accordance with a first embodiment of the present invention. In this first embodiment, the mounting apparatus comprises an elongated member 2 having an upper side 100 and a lower side 110 and first and second ends 200, 220. In the embodiment shown in FIG. 1, an at least one snow plow mounting member 4 is secured to the elongated member. While the shape and size of the at least one snow plow mounting member 4 will depend upon the type of snow plow being used, the at least one snow plow mounting member 4 may optionally take the form of a pair of substantially cylindrically shaped pins, as depicted in FIG. 1, wherein each of the at least one mounting pins is positioned on the upper side 100 of the elongated member 2. In the embodiment shown in FIG. 1, two snow plow mounting members are distally located on the upper side 100 of the elongated member 2 at or near the first and second ends 200, 220 thereof.

Figure 2:
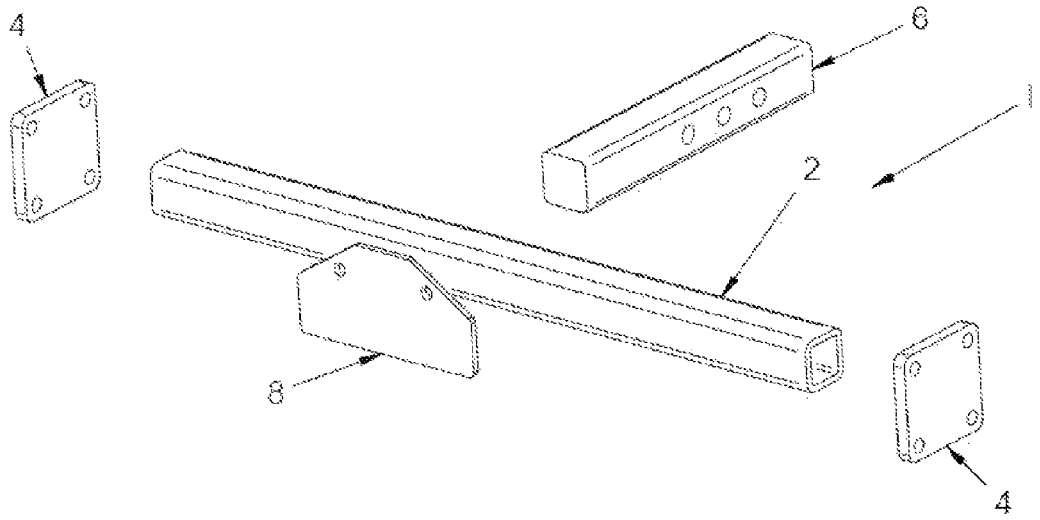
FIG. 2 is an exploded perspective view of a second embodiment of a universal snow plow mounting apparatus of the present invention.
Figure 18:
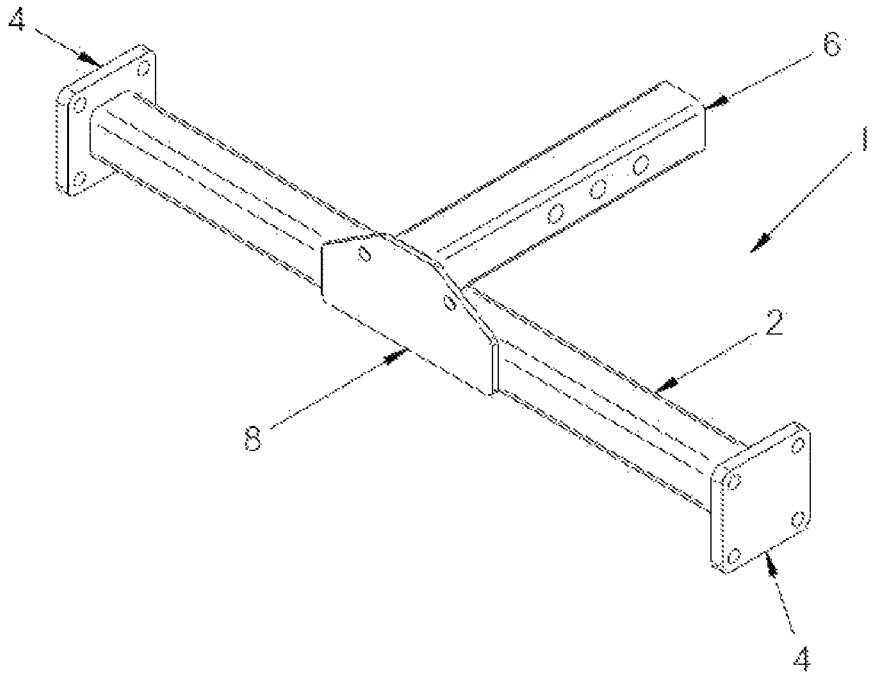
FIG. 18 is perspective view of the universal snow plow mounting apparatus of FIG. 2.

In the embodiments shown in FIG. 2 and FIG. 18, each of the at least one snow plow mounting members 4 takes the form of a pair of substantially planar mounting plates, where one mounting plate is secured to the elongated member 2 at its first end 200 and a second mounting plate is secured to the elongated member 2 at its second end 220.

Each of the at least one snow plow mounting members 4 functions to releasably connect the mounting apparatus 1 to a snow plow (not shown) on a first side 300 of the mounting apparatus 1. While a single snow plow mounting member could be used to connect the mounting apparatus 1 to such snow plow, in order to ensure secure positioning of the snow plow on the mounting apparatus 1, it is preferred that at least two snow plow mounting members which are distally positioned on the elongated member 2, are employed. Standard connecting means, such as a male/female connection, may be used to attach each of the at least one snow plow mounting members 4 to an at least one attachment point on the snow plow.

Still referring to FIG. 1, a vehicle mounting member 6 is positioned on the elongated member 2 and attached thereto, the vehicle mounting member 6 for engaging with a receiver or receiver hitch (not shown) secured to the front of the vehicle (not shown) to which the snow plow is to be mounted. The vehicle mounting member 6 extends outwardly from the elongated member 2 to ensure sufficient clearance between the mounting apparatus 1 and the front bumper of the vehicle (not shown). The vehicle mounting member 6 functions to releasably connect the mounting apparatus 1 to a vehicle on a second side 330 of the mounting apparatus 1, wherein the first 300 and second sides 330 of the mounting apparatus oppose each other. Standard vehicle receivers (or receiver hitches) take the form of a hollow square shaped 1" to 2" connection point positioned on the underside of the vehicle at or near the front of the vehicle. In both embodiments shown in FIGS. 1 and 2, the vehicle mounting member 6 takes the form of a cuboid, or rectangular cuboid. The vehicle mounting member 6 is sized to fit within a standard vehicle receiver. In an optional embodiment best shown in FIG. 11, the vehicle mounting member 6 includes a plurality of apertures 10, positioned latitudinally on two opposite sides of the vehicle mounting member 6, wherein the plurality of apertures are sized and positioned on the vehicle mounting member 6 to correspond to apertures positioned on two opposite sides of the vehicle receiver. In this way the vehicle mounting member 6 can be positioned along the length of the vehicle receiver, and secured in place by a standard hitch fastener, such as a hitch pin. In a preferred embodiment of the present invention, the vehicle mounting member 6 is substantially medially positioned on the elongated member 2.

A support member 8 associated with the elongated member 2 is employed to engage the vehicle mounting member 6 and secure the vehicle mounting member 6 to the elongated member 2. The support member 8 functions to enhance the structural integrity of the mounting apparatus 1, including by providing additional rigidity at the connecting point between the mounting apparatus 1 and the vehicle mounting member 6. The components of the apparatus 1 can be fabricated from mild steel or aluminum, or any other suitably strong material.

Figure 3:
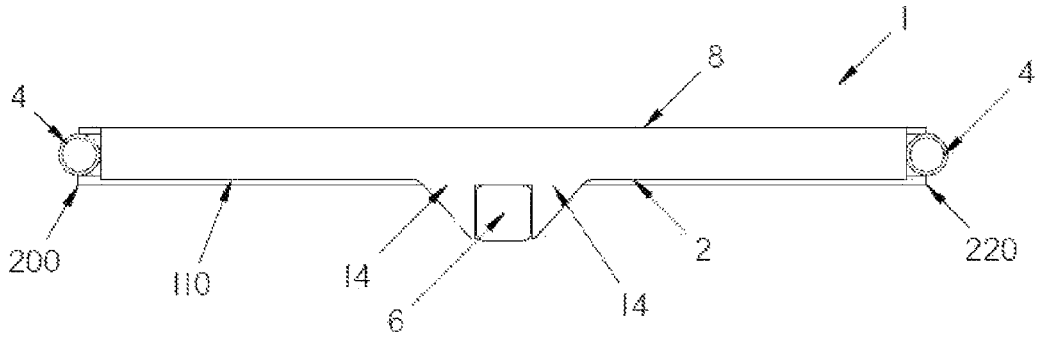
FIG. 3 is a front view of the universal snow plow mounting apparatus of FIG. 1.
Figure 9:
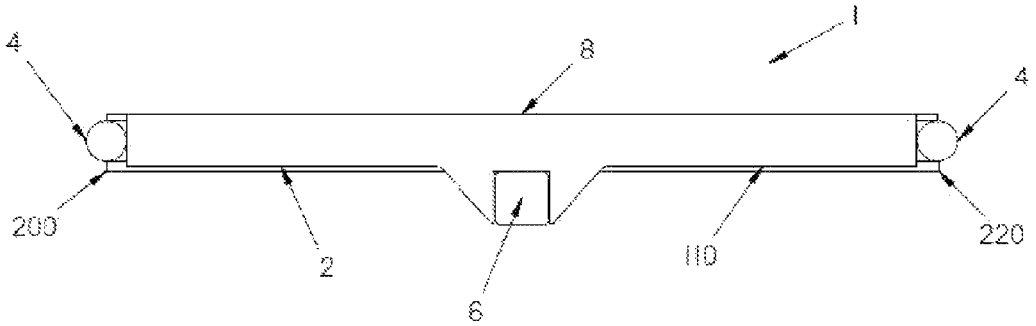
FIG. 9 is a rear view of the universal snow plow mounting apparatus of FIG. 1.

In the first embodiment of the present invention illustrated in FIG. 3, the support member 8 takes the form of an extended sleeve which substantially spans the length of the elongated member 2 and which interconnects with each of the at least one snow plow mounting members 4 to augment the strength of connection between each of the at least one snow plow mounting members 4 and the mounting apparatus 1 itself. In this embodiment, a flange portion 12 is positioned proximate to the upper end of the support member 8. The flange portion 12 is located on the support member 8 at position substantially corresponding to the location of the vehicle mounting member 6 (wherein the vehicle mounting member 6 itself is connected to the elongated member 2). In the embodiment shown in FIGS. 3 and 9, the flange portion 12 includes two downwardly extending projections 14, the projections 14 spaced to accommodate the vehicle mounting member 6 between them. The projections 14 serve to prevent substantial lateral movement of the vehicle mounting member 6, when the vehicle mounting member 6 is subjected to a lateral force (for example, via lateral force applied to the snow plow itself). In an optional embodiment best shown in FIG. 5, two identical flange portions 12 are positioned on the support member 8 proximate to the upper end of the support member 8, wherein each flange portion includes two downwardly extending projections 14, the projections 14 spaced to accommodate the vehicle mounting member 6 between them. Where two sets of projections 14 are employed, the vehicle mounting member 6 is laterally supported at two points along its length, further enhancing the structural rigidity of the apparatus 1.

Figure 4:
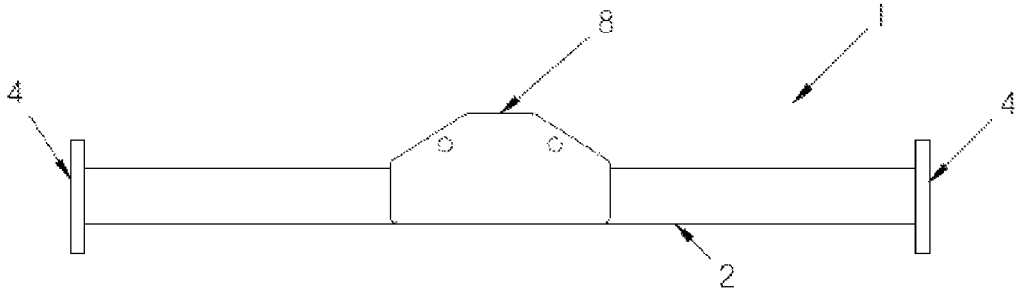
FIG. 4 is a front view of the universal snow plow mounting apparatus of FIG. 2.
Figure 10:
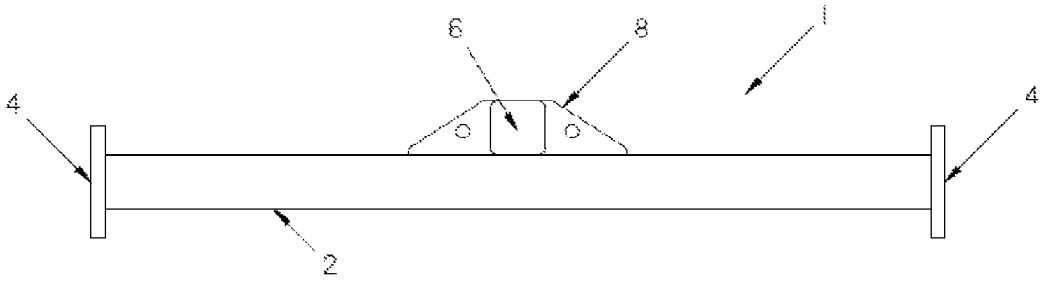
FIG. 10 is a rear view of the universal snow plow mounting apparatus of FIG. 2.

In the embodiment shown in FIGS. 4 and 10, the support member 8 takes the form of a substantially planar member positioned proximate to the elongated member 2 and in substantial alignment with the vehicle mounting member 6. In this embodiment, the support member 8 is itself connected to the vehicle mounting member 6. This arrangement provides additional rigidity to the mounting apparatus 1 vehicle mounting member 6 connection. Optionally, the vehicle mounting member 6 is directly connected to the support member 8, while the support member 8 itself, and not the vehicle mounting member 6, is connected to the elongated member 2.

As seen in FIGS. 3 and 4, the vehicle mounting member 6 may be positioned either above or below the elongated member 2, and in the embodiment shown in FIG. 4, at a position along the vertical planar axis of the snow plow mounting member 4.

Figure 5:
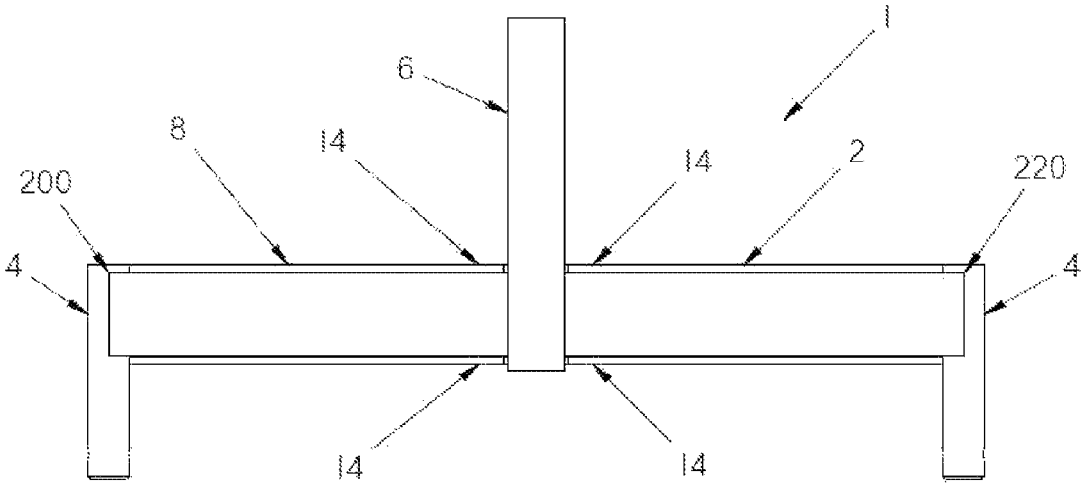
FIG. 5 is a bottom view of the assembled universal snow plow mounting apparatus of FIG. 1.
Figure 6:
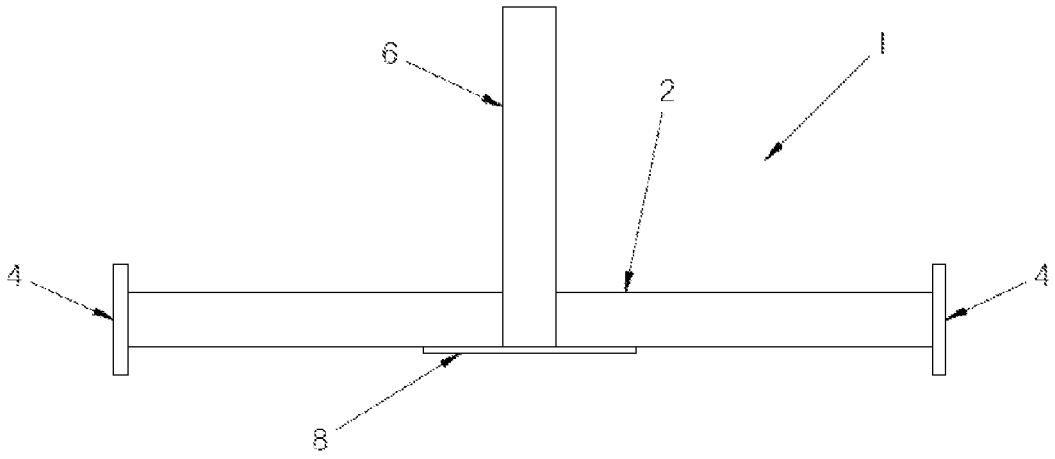
FIG. 6 is a bottom view of the universal snow plow mounting apparatus of FIG. 2.
Figure 7:
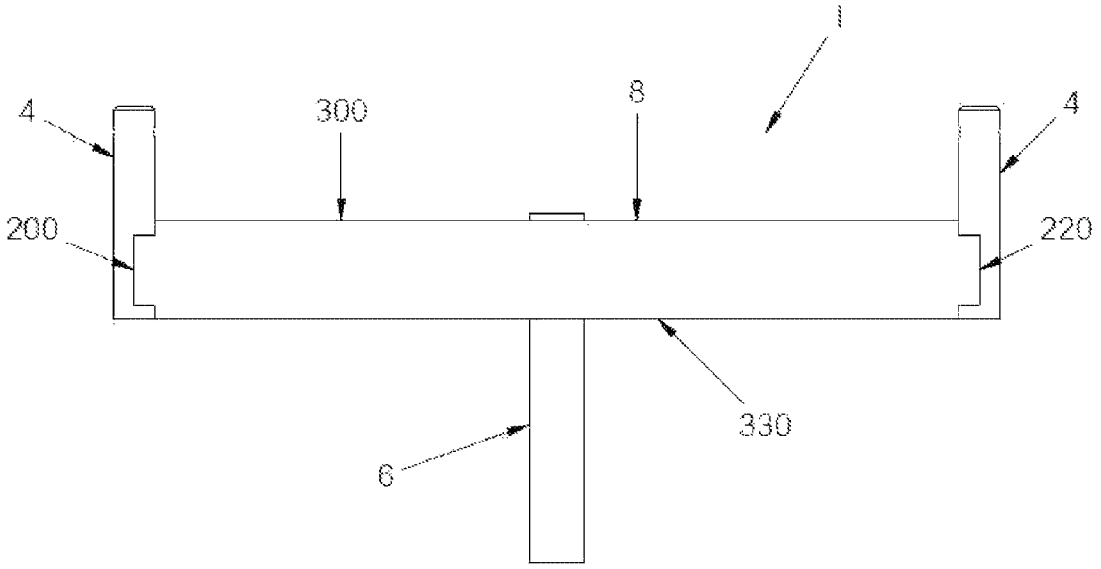
FIG. 7 is a top view of the universal snow plow mounting apparatus of FIG. 1.
Figure 8:
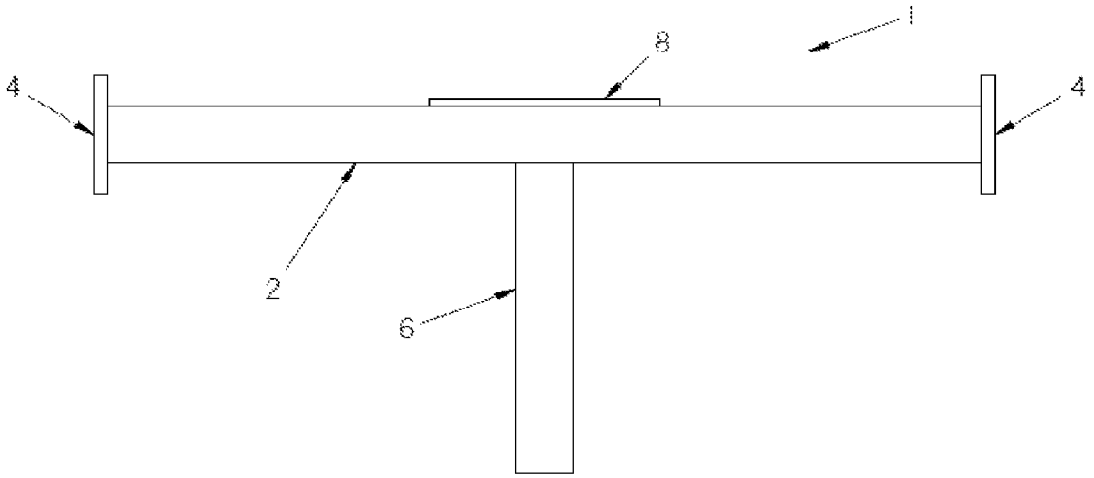
FIG. 8 is a top view of the universal snow plow mounting apparatus of FIG. 1.

The position of the vehicle mounting member 6 relative to the mounting apparatus 1 is best shown in FIGS. 5-8, and 11-12. In FIG. 5, it can be seen that the mounting pins and the vehicle mounting member 6 extend from opposite sides of the elongated member 2. Note that the apertures positioned on the planar surface of the elongated member 2, and shown in FIG. 5, provide additional connection points between the support member 8 and the elongated member 2.

Figure 11:
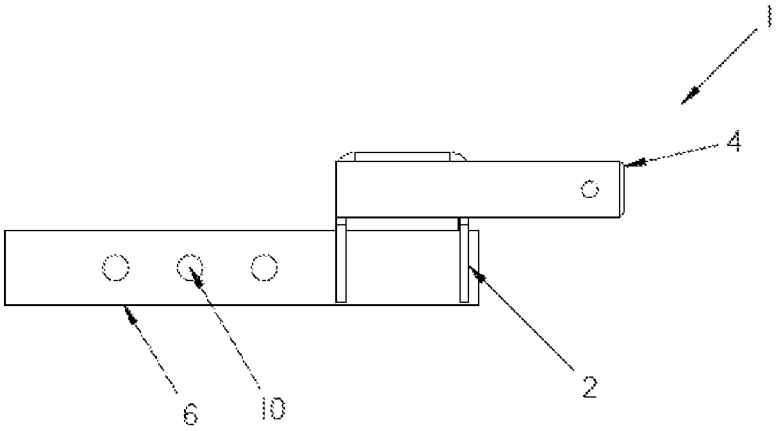
FIG. 11 is a side view of the universal snow plow mounting apparatus of FIG. 1.

As shown in FIG. 11, each of the at least one snow plow mounting members 4 of the first embodiment of the present invention may be positioned above the horizontal plane of the vehicle mounting member 6. Alternatively, by reversing the positions of the elongated member 2 and the support member 8, each of the at least one snow plow mounting members 6 may be positioned below the horizontal plane of the vehicle mounting member 6. In this way the first embodiment of the present invention supports two different heights of the vehicle mounting member 6 relative to the vehicle, which heights are tied to the height dimensions of the vertical planar axis of the mounting apparatus 1, and which height dimensions are sized to accommodate the differentiation in vehicle, including principally automobile, ground clearance.

Figure 12:
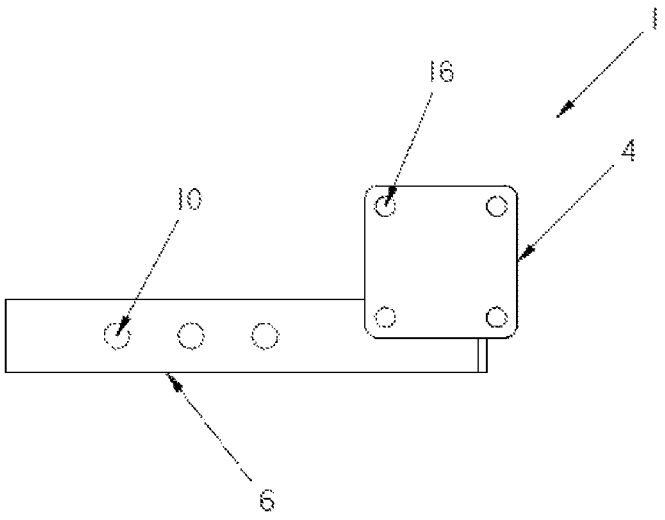
FIG. 12 is a side view of the universal snow plow mounting apparatus of FIG. 2.
Figure 13:
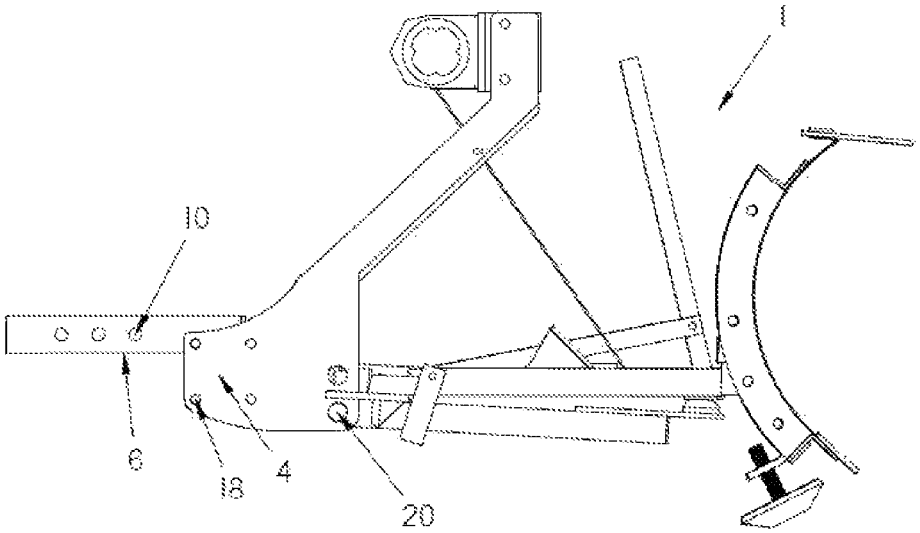
FIG. 13 is a side view of a third embodiment of a universal snow plow mounting apparatus of the present invention with a snow plow mounted thereon at its lowest mounting position.
Figure 14:
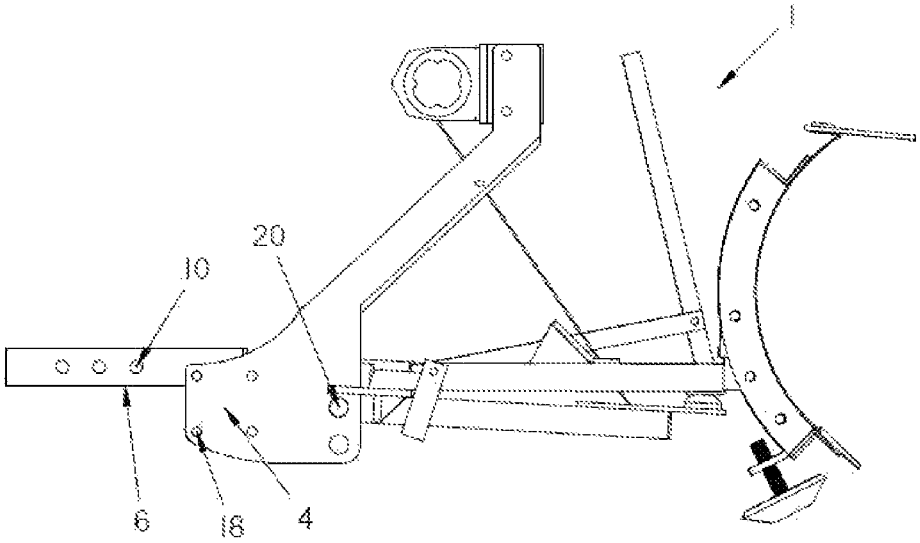
FIG. 14 is a side view of the universal snow plow mounting apparatus of FIG. 13 with a snow plow mounted thereon at its second lowest mourning position.
Figure 15:
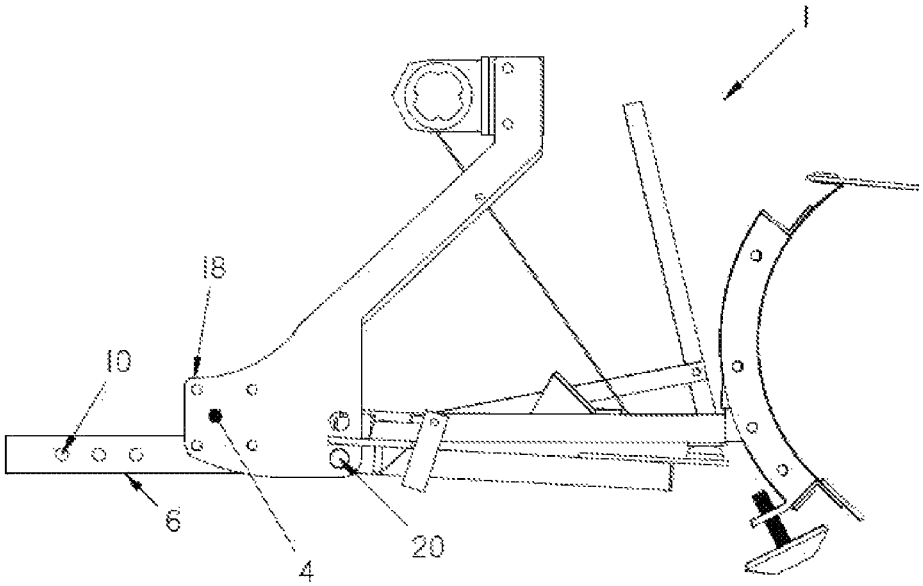
FIG. 15 is a side view of the universal snow plow mounting apparatus of FIG. 13 with a snow plow mounted thereon at its third lowest mounting position.
Figure 16:
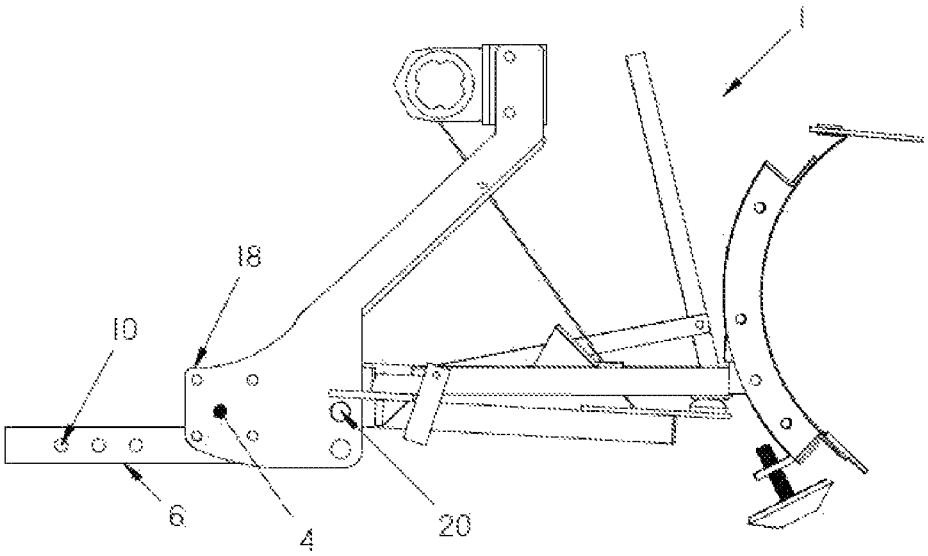
FIG. 16 is a side view of the universal snow plow mounting apparatus of FIG. 13 with a snow plow mounted thereon at its highest mounting position.

In the second embodiment illustrated in FIG. 12 each of the at least one snow plow mounting members 4 includes height adjustment means 16 in the form of notched portions or apertures positioned along the vertical planar axis thereof, such height adjustment means 16 for enabling a user to adjust the height of the vehicle mounting member 6 on the at least one snow plow mounting member 4. The vehicle mounting member 6 may be positioned above or below the elongated member 2 by adjusting the position of the vehicle mounting member 6 along the vertical planar axis of the snow plow mounting member 4 via the height adjustment means 16.

FIGS. 13-16 illustrate the snow plow mounting apparatus 1, in accordance with a third embodiment of the present invention, wherein a snow plow is mounted on the apparatus 1 via the at least one snow plow mounting member 4. In this embodiment, each of the at least one snow plow mounting members 4 includes a first height adjustment means 18 in the form of notched portions or apertures positioned along the vertical planar axis thereof, such height adjustment means 18 for enabling a user to adjust the height of the vehicle mounting member 6 on the at least one snow plow mounting member 4, and a second height adjustment means 20 in the form of notched portions or apertures positioned along the same vertical planar axis of each of the at least one snow plow mounting members 4, where such second height adjustment means 20 are positioned distally from the vehicle mounting member 6. The second height adjustment means 20 are adapted for direct engagement with the mounting mechanism contained on the snow plow. In this embodiment, both the height (or vertical positioning) of the vehicle mounting member 6 about the mounting apparatus 1 and the height (or vertical positioning) of the snow plow about the mounting apparatus 1 can be adjusted.

While one or more embodiments of this invention have been illustrated in the accompanying drawings and described above, it will be evident to those skilled in the art that changes and modifications can be made therein without departing from the essence of this invention. All such modifications are believed to be within the sphere and scope of the invention as defined by the claims appended hereto.

What is claimed is:

1. A height adjustable snow plow mounting apparatus for mounting a snow plow onto a receiver secured to the front of a motor vehicle, the snow plow mounting apparatus comprising:

an elongated member having an upper side and a lower side and a first end and a second end;

an at least one snow plow mounting member positioned at or near each of the first and second ends of the elongated member, each snow plow mounting member for releasably connecting the snow plow mounting apparatus to a snow plow on a first side of the snow plow mounting apparatus;

an at least one vehicle mounting member positioned on the elongated member and extending outwardly therefrom, the vehicle mounting member for engaging with the receiver for the purpose of releasably connecting the snow plow mounting apparatus on a second side of the snow plow mounting apparatus;

a support member for engaging the vehicle mounting member and securing the vehicle mounting member to the elongated member, the support member comprising an extended sleeve which substantially spans the length of the elongated member;

a flange portion positioned on the support member at a position substantially corresponding to the location of the vehicle mounting member, the flange portion comprising at least two downwardly extending projections, the projections spaced to accommodate the vehicle mounting member between them for the purpose of preventing substantial lateral movement of the vehicle mounting member;

wherein each of the at least one snow plow mounting members may be positioned at a height above or below the horizontal plane of the vehicle mounting member by reversing the positions of the elongated member and the support member, which orientations support two different heights of the vehicle mounting member relative to the motor vehicle, which heights are based upon standard height differences in motor vehicle around clearance.

2. The snow plow mounting apparatus of claim 1, wherein the vehicle mounting member may be positioned above or below the elongated member.

3. The snow plow mounting apparatus of claim 1, wherein the vehicle mounting member is positioned along a vertical planar axis of each of the at least one snow plow mounting members.

4. The snow plow mounting apparatus of claim 1, wherein the first and second sides substantially oppose each other.

5. The snow plow mounting apparatus of claim 1, wherein the vehicle mounting member further comprises a plurality of apertures positioned latitudinally on opposite sides of the vehicle mounting member, wherein the plurality of apertures are sized and positioned on the vehicle mounting member to correspond to apertures positioned on opposite sides of the vehicle receiver.

6. The snow plow mounting apparatus of claim 1, wherein the support member interconnects with each of the at least one snow plow mounting members to augment the strength of the connection between each of the at least one snow plow mounting members and the snow plow mounting apparatus.

7. The snow plow mounting apparatus of claim 1, wherein the support member is fused to the elongated member.

8. The snow plow mounting apparatus of claim 1, wherein the support member is a substantially planar member positioned proximate to the elongated member and substantially aligned with the vehicle mounting member.

9. The snow plow mounting apparatus of claim 1, wherein each of the at least one snow plow mounting members further comprises a height adjustment means.

10. The snow plow mounting apparatus of claim 6, wherein the vehicle mounting member may also be positioned above or below the elongated member by adjusting the position of the vehicle mounting member along the vertical planar axis of each of the at least one snow plow mounting members via the height adjustment means.

11. The snow plow mounting apparatus of claim 1, wherein the flange portion comprises two identical flange portions positioned proximate to an upper end of the support member.

12. The snow plow mounting apparatus of claim 1, wherein the vehicle mounting member is sized to extend outwardly from the elongated member to ensure sufficient clearance between the snow plow mounting apparatus and a front bumper of the motor vehicle.

13. The snow plow mounting apparatus of claim 1, wherein each of the at least one snow plow mounting members takes the form of a substantially planar mounting plate.

14. The snow plow mounting apparatus of claim 1, wherein each of the at least one snow plow mounting members takes the form of a substantially cylindrically shaped pin.

* * * * *